US009455530B2

(12) United States Patent
Patel

(10) Patent No.: US 9,455,530 B2
(45) Date of Patent: Sep. 27, 2016

(54) ELECTRICAL CONNECTOR WITH GROUND BUS

(71) Applicant: Tyco Electronics Corporation, Berwyn, PA (US)

(72) Inventor: Sandeep Patel, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 13 days.

(21) Appl. No.: 14/321,416

(22) Filed: Jul. 1, 2014

(65) Prior Publication Data

US 2016/0006182 A1 Jan. 7, 2016

(51) Int. Cl.

| | |
|---|---|
| ***H01R 13/652*** | (2006.01) |
| ***H01R 13/6471*** | (2011.01) |
| ***H01R 13/6597*** | (2011.01) |
| *H01R 12/72* | (2011.01) |
| *H01R 12/73* | (2011.01) |

(52) U.S. Cl.

CPC ..... *H01R 13/652* (2013.01); *H01R 13/6471* (2013.01); *H01R 13/6597* (2013.01); *H01R 12/724* (2013.01); *H01R 12/732* (2013.01)

(58) Field of Classification Search

CPC ..... H01R 4/64; H01R 4/66; H01R 23/005; H01R 13/6471; H01R 13/6596; H01R 13/652

USPC ..... 439/92–108, 607.09–607.15, 607.4, 439/614, 660, 607.17, 607.31–607.34, 79

See application file for complete search history.

(56) References Cited

U.S. PATENT DOCUMENTS 5,114,355 A * 5/1992 Kimmel et al. ..... 439/101
5,453,026 A * 9/1995 Ikegami ..... 439/579
6,036,506 A * 3/2000 Korsunsky ..... H01R 12/716 439/637
6,322,392 B1 * 11/2001 Wang ..... 439/607.14
6,364,706 B1 * 4/2002 Ando ..... H01R 23/6873 439/607.37
6,641,438 B1 * 11/2003 Billman ..... H01R 13/65802 439/607.07
6,739,911 B2 * 5/2004 Wagatsuma ..... H01R 13/629 439/607.31
8,221,139 B2 7/2012 Qin et al.
8,764,464 B2 * 7/2014 Buck ..... H01R 13/514 439/108

(Continued)

FOREIGN PATENT DOCUMENTS

WO 2014061284 4/2014

OTHER PUBLICATIONS

International Search Report dated Sep. 23, 2015 received in counterpart PCT Application No. PCT/US2015/036416.

*Primary Examiner* — Amy Cohen Johnson
*Assistant Examiner* — Milagros Jeancharles

(57) ABSTRACT

An electrical connector includes a housing having a front and a rear. The housing including a slot defined through the front that is configured to receive a mating connector therein. Signal contacts are held in the housing. The signal contacts are arranged within the slot to mate with the mating connector. Ground contacts are held in the housing and interspersed among the signal contacts. The ground contacts are arranged within the slot to mate with the mating connector. A ground bus includes a base and multiple sets of projections extending from the base. Each set including at least two projections that engage the same corresponding ground contact at spaced-apart locations. The sets of projections are connected via the base to create a ground circuit between the ground contacts that are engaged by the ground bus.

20 Claims, 4 Drawing Sheets

(56) References Cited

U.S. PATENT DOCUMENTS

| | | | | |
|---|---|---|---|---|
| 8,858,243 | B2 * | 10/2014 | Luo et al. | 439/108 |
| 8,944,849 | B1 * | 2/2015 | Yang et al. | 439/607.07 |
| 2005/0032425 | A1 | 2/2005 | Tanaka | |
| 2012/0064743 | A1 | 3/2012 | Qin et al. | |
| 2013/0178101 | A1 * | 7/2013 | Tao | H01R 13/6581 439/607.53 |
| 2013/0303027 | A1 * | 11/2013 | Hsu | H01R 13/518 439/626 |
| 2013/0309906 | A1 | 11/2013 | De Geest | |
| 2013/0337676 | A1 | 12/2013 | Hsueh | |
| 2014/0080331 | A1 * | 3/2014 | Jeon | H01R 13/65807 439/84 |
| 2015/0050842 | A1 * | 2/2015 | Miki | H01R 12/716 439/668 |

* cited by examiner

ELECTRICAL CONNECTOR WITH GROUND BUS

BACKGROUND OF THE INVENTION

The subject matter herein relates generally to electrical connectors having ground buses.

In computers and other applications, it is common to form a plurality of electrical connections between two printed circuit boards. These connections can be achieved through an interface between an edge of one printed circuit board and an electrical connector mounted on the other printed circuit board. Each application requires a certain orientation of the boards relative to each other. For example, the application may require that the boards be positioned perpendicular to each other. Other applications may require the boards to be positioned parallel to each other.

One way to achieve a parallel interface is to mount a right angle electrical connector on a printed circuit board which receives the edge of the other board. The right angle electrical connectors typically include a housing with contacts arranged in rows to mate to a mating printed circuit board. The housing supports the contacts in a right angle orientation. The contacts typically comprise signal contacts arranged in pairs isolated from other pairs of signal contacts by ground contacts in order to minimize crosstalk between the pairs. However, known electrical connectors are not without disadvantages. For instance, while the ground contacts do isolate signal pairs, the length of the ground contacts between the mating interface at the mating circuit board and the mounting interface at the mounting circuit board leads to resonances or resonance noise. The resonance noise is due to standing electromagnetic waves created at the ends of the ground contacts that propagate along the ground contacts and cause the electrical potential of the ground contact to vary along the length. The resonance noise can couple to signal pairs to degrade the signal performance. The resonance noise and crosstalk between signal pairs increases as the electrical connectors are used to convey more data at faster data rates and transmitted at higher frequencies. The resonance noise also increases as the length of the ground contacts between grounding locations increases.

A need remains for an electrical connector that provides signal pair isolation and that reduces resonance noise that degrades signal performance.

BRIEF DESCRIPTION OF THE INVENTION

In one embodiment, an electrical connector is provided including a housing having a front and a rear. The housing including a slot defined through the front that is configured to receive a mating connector therein. Signal contacts are held in the housing. The signal contacts are arranged within the slot to mate with the mating connector. Ground contacts are held in the housing and interspersed among the signal contacts. The ground contacts are arranged within the slot to mate with the mating connector. A ground bus includes a base and multiple sets of projections extending from the base. Each set including at least two projections that engage the same corresponding ground contact at spaced-apart locations. The sets of projections are connected via the base to create a ground circuit between the ground contacts that are engaged by the ground bus.

In another embodiment, an electrical connector is provided including a housing having a top and a bottom. The bottom is configured to be mounted to a circuit board. The housing has a front and a rear opposite the front. The housing defining a slot through the front configured to receive a mating card module therein and configured to hold the mating card module parallel to the circuit board. Signal contacts and ground contacts are held in the housing. The signal contacts are arranged in pairs. At least one ground contact is disposed between each pair of signal contacts. Each of the signal contacts and ground contacts has a mating arm that extends into the slot and is configured to engage the mating card module. Each of the signal contacts and ground contacts has a mounting arm that extends at an angle from the mating arm and is configured to be terminated to the circuit board. A ground bus includes a base and multiple sets of projections extending from the base. Each set includes at least two projections that engage the same corresponding ground contact at spaced-apart locations. The sets of projections are connected via the base to create a ground circuit between the ground contacts that are engaged by the ground bus.

DETAILED DESCRIPTION OF THE INVENTION

Embodiments set forth herein include electrical connectors that have ground buses that engage ground contacts at multiple locations along the length of the ground contacts to define a ground circuit. The multiple locations of engagement are configured to reduce the distances along the ground contacts between grounding points. The shorter distances reduce the magnitude of resonance peaks through the ground contacts and increase the resonating frequencies of the electrical connectors to values that are beyond desired operating frequency ranges, improving signal performance.

Figure 1:
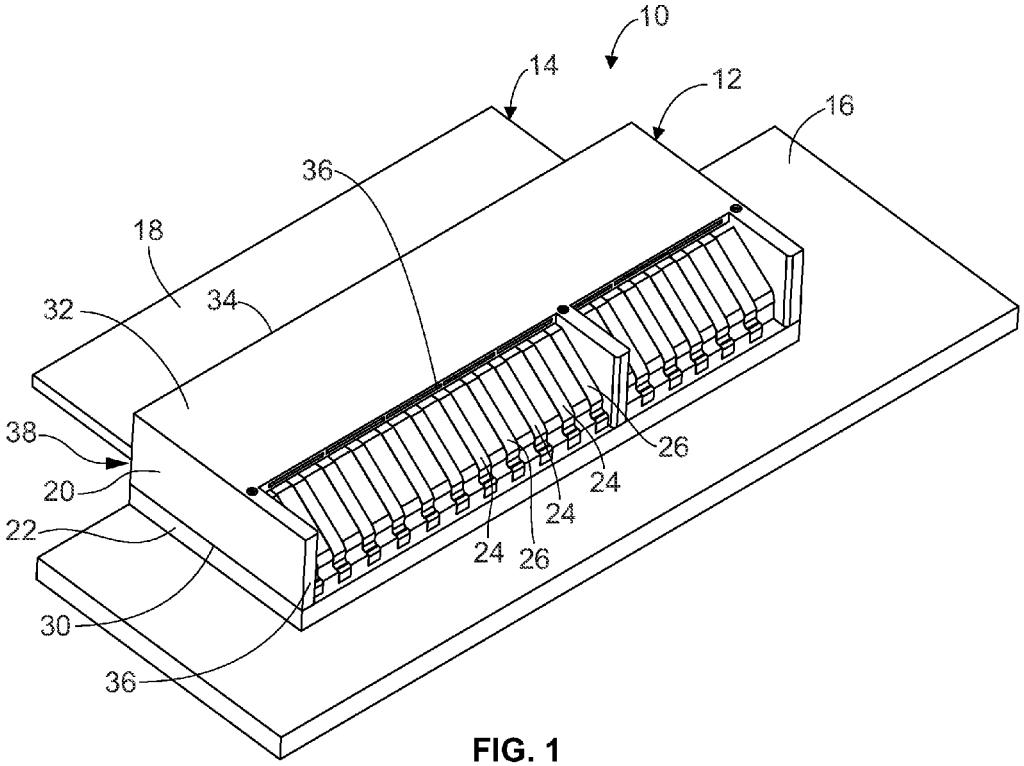
FIG. 1 is a perspective view of a portion of an electronic device having an electrical connector formed in accordance with an exemplary embodiment.

FIG. 1 is a perspective view of a portion of an electronic device 10 that includes an electrical connector 12 formed in accordance with an exemplary embodiment. A mating connector 14 is mated to the electrical connector 12. The electronic device 10 includes a circuit board 16, and the electrical connector 12 is mounted to the circuit board 16. The electrical connector 12 is used to interconnect the mating connector 14 and the circuit board 16.

In an exemplary embodiment, the electronic device 10 constitutes a computer, however the electronic device 10 may be another type of device such as a server, a consumer electronic device, an industrial electronic device, and the like. The circuit board 16 is held within the electronic device 10, such as within a housing (not shown) of the electronic device 10. The electrical connector 12 may be mounted internally, such as within the housing, or alternatively, may be mounted externally, such as outside the housing. Optionally, the electrical connector 12 may be mounted internally, with a mating face of the electrical connector 12 aligned with an opening or port in the housing to allow access to the electrical connector 12 from outside the electronic device 10. The mating connector 14 may then be mated with the electrical connector 12 from outside the electronic device 10. Alternatively, both the electrical connector 12 and mating connector 14 may be housed within the housing of the electronic device 10.

In an exemplary embodiment, the electrical connector 12 constitutes a right angle card edge connector. For example, the mating connector 14 may constitute a mating card module configured to be plugged into the electrical connector 12. The mating connector 14 includes a card module circuit board 18 having a plurality of pads arranged along an edge of the card module circuit board 18. The edge of the card module circuit board 18 is plugged into the electrical connector 12. The electrical connector 12 defines a right angle connector, wherein the mating connector 14 is mated along a direction that is parallel to the circuit board 16. The card module circuit board 18 is held within the electrical connector 12 such that the card module circuit board 18 is held parallel to the circuit board 16.

While the electrical connector 12 is illustrated and described as being a right angle electrical connector, it is realized that the electrical connector 12 may have other configurations in alternative embodiments. For example, the electrical connector 12 may be a vertical connector that receives the mating connector 14 in a perpendicular orientation with respect to the circuit board 16. The electrical connector 12 may constitute another type of connector other than a card edge connector. For example, the electrical connector 12 may be mated with a different type of mating connector, such as a mating connector that is mounted to another circuit board, such as a daughter card. The mating connector 14 may thus include a housing holding a plurality of individual contacts that are terminated to the other circuit board and that are configured to be mated to the electrical connector 12. The subject matter herein is not intended to be limited to a right angle card edge connector.

The electrical connector 12 includes a housing 20 and organizer 22 positioned between the housing 20 and the circuit board 16. The electrical connector 12 also includes signal contacts 24 and ground contacts 26 held within the housing 20. The ground contacts 26 are interspersed among the signal contacts 24. The signal and ground contacts 24, 26 are also held by the organizer 22 for mounting to the circuit board 16. Optionally, the electrical connector 12 may be provided without the organizer 22, such that the housing 20, signal contacts 24, and ground contacts 26 are directly mated to the circuit board 16.

The housing 20 has a bottom 30 and a top 32 opposite the bottom 30. The bottom 30 is configured to be mounted to the organizer 22 and/or to the circuit board 16. The housing 20 has a front 34 and a rear 36 opposite the front 34. The signal and ground contacts 24, 26 extend from the rear 36 down to the organizer 22. The mating connector 14 is coupled to the electrical connector 12 at the front 34. The housing 20 includes a slot 38 defined through the front 34. The slot 38 is configured to receive the mating connector 14 therein. For example, the housing 20 may be a right angle housing such that the bottom 30 is mounted directly or indirectly to the circuit board 16, and the slot 38 receives the mating connector 14 in a direction parallel to the circuit board 16. Portions of the signal and ground contacts 24, 26 are arranged within the slot 38 to mate with the mating connector 14. The mating connector 14 may extend from the front 34 when mated to the electrical connector 12.

In an exemplary embodiment, the electrical connector 12 is an audio input-output (I/O) connector configured to convey signals at a relatively high data transfer rate. For example, the electrical connector 12 may support data transfer rates of at least 25 gigabits per second (Gbps). At the higher operating frequencies necessary to transmit information at such a rate, the ground contacts of typical electrical connectors experience high resonance peaks that increase resonance noise and degrade signal performance. The electrical connector 12 is configured to provide signal pair isolation and multi-point grounding that reduces resonance noise at the desired operating frequencies to improve signal performance.

Figure 2:
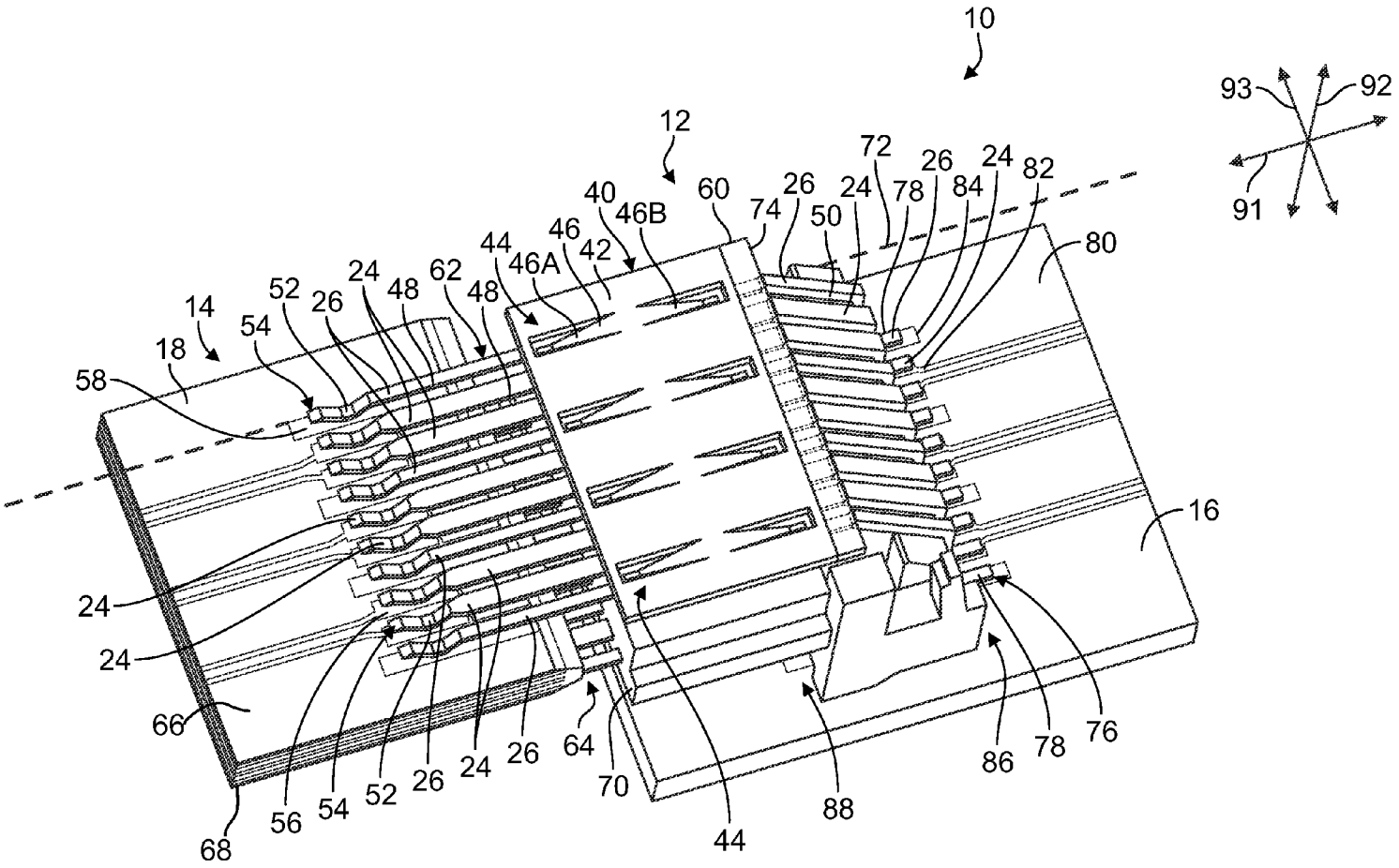
FIG. 2 is a perspective view of a portion of the electronic device showing the electrical connector and a mating connector according to an embodiment, with a housing of the electrical connector removed for clarity.

FIG. 2 is a perspective view of a portion of the electronic device 10 showing the electrical connector 12 and the mating connector 14 according to an embodiment, with the housing 20 of the electrical connector 12 removed for clarity. The electrical connector 12 includes at least one ground bus 40 that engages the ground contacts 26 at intermediate locations between ends of the ground contacts 26. The ground bus 40 includes a base 42 and multiple sets 44 of projections 46 that extend from the base 42. Each set 44 is associated with a corresponding ground contact 26. For example, each set 44 includes at least two projections 46 that engage the same ground contact 26 at spaced-apart locations. The projections 46 from the multiple sets 44 are connected to each other via the base 42. The projections 46 and the base 42 are electrically conductive such that the projections 46 are electrically connected to each other via the base 42 to create a ground circuit between the ground contacts 26 that are engaged by the ground bus 40. As a result, the ground contacts 26 are electrically commoned via the ground bus 40.

The signal contacts 24 and the ground contacts 26 may be held in place within the housing 20 (shown in FIG. 1) by a dielectric frame 60. The dielectric frame 60 is formed of a dielectric material, such as plastic. Optionally, the dielectric frame 60 may be over-molded around the contacts 24, 26 to isolate and hold the contacts 24, 26 in place. In an embodiment, the signal and ground contacts 24, 26 are arranged in a row 62 along a lateral axis 93 of the electrical connector 12. For example, the electronic device 10 is oriented with respect to a mating or insertion axis 91, an elevation axis 92, and a lateral axis 93. The axes 91-93 are mutually perpendicular with respect to one another. Although the elevation axis 92 appears to extend in a vertical direction parallel to gravity in FIG. 2, it is understood that the axes 91-93 are not required to have any particular orientation with respect to gravity. The signal and ground contacts 24, 26 may be held to extend along respective contact axes 72 that are parallel to the mating axis 91 of the electrical connector 12. For example, the signal and ground contacts 24, 26 may be held by the dielectric frame 60 in a parallel orientation with each other. In an exemplary embodiment, the signal and ground contacts 24, 26 of the electrical connector 12 are arranged in two rows 62, 64, such that the row 62 is an upper row and the row 64 is a lower row. Referring back to FIG. 1, the upper row 62 of contacts 24, 26 is disposed along a top of the slot 38 of the housing 20, and the lower row 64 is disposed along a bottom of the slot 38, such that the card module circuit board 18 is configured to be received between the upper and lower rows 62, 64.

Referring again to FIG. 2, the card module circuit board 18 has a top side 66 and a bottom side 68. A plurality of signal traces 56 are arranged along the top and bottom sides 66, 68. The card module circuit board 18 includes a plurality of ground pads 58 arranged along the top and bottom sides 66, 68. Each of the ground pads 58 may be electrically commoned with a ground layer of the card module circuit board 18. The signal and ground contacts 24, 26 in the upper row 62 are configured to engage the respective signal traces 56 and ground pads 58 along the top side 66 of the card module circuit board 18 when the mating card module 14 is loaded into the housing 20 (shown in FIG. 1). Likewise, the signal and ground contacts 24, 26 in the lower row 64 are configured to engage the respective signal traces 56 and ground pads 58 along the bottom side 68 of the loaded card module circuit board 18.

The signal contacts 24 and ground contacts 26 may be arranged in any pattern depending on the particular application. In an embodiment, the signal contacts 24 are arranged in pairs. The signal contacts 24 may be in pairs to carry differential signals. The pairs of signal contacts 24 are separated by at least one ground contact 26. In the illustrated embodiment, a single ground contact 26 is provided between adjacent pairs of signal contacts 24, such as to define a ground-signal-signal-ground-signal-signal pattern. Alternatively, two ground contacts 26 may be provided between adjacent pairs to define a repeating ground-ground-signal-signal-ground-ground-signal-signal pattern. In other alternative embodiments, rather than carrying differential signals, the signal contacts 24 may be configured to carry single ended signals. In such embodiments, each signal contact 24 may be separated from adjacent signal contacts 24 by one or more ground contacts 26. The pattern of signal traces 56 and ground pads 58 corresponds with the pattern of signal and ground contacts 24, 26.

In an embodiment, each of the signal and ground contacts 24, 26 has a mating arm 48 that extends into the slot 38 (shown in FIG. 1) of the housing 20 (FIG. 1) and is configured to engage the card module circuit board 18 of the mating connector 14 (for example, mating card module). In an alternative embodiment in which the mating connector 14 does not include a card module circuit board 18, but rather includes individual contacts held within a housing, the mating arms 48 are configured to engage the corresponding contacts of the mating connector 14. The mating arms 48 may extend from a front 70 of the dielectric frame 60 to a distal end 54 of the contacts 24, 26. The mating arms 48 of the signal and ground contacts 24, 26 include a mating interface 52 proximate to the distal ends 54. The mating interface 52 is the portion of the mating arm 48 that is configured to engage the card module circuit board 18. For example, the mating interfaces 52 of the signal contacts 24 engage corresponding signal traces 56 on the top and bottom sides 66, 68 of the card module circuit board 18, while the mating interfaces 52 of the ground contacts 26 engage corresponding ground pads 58 on the top and bottom sides 66, 68 of the circuit board 18.

In addition, each of the signal and ground contacts 24, 26 includes a mounting arm 50 that extends at an angle from the mating arm 48. The mounting arm 50 is configured to be terminated to the circuit board 16. The mounting arm 50 may extend from a rear 74 of the dielectric frame 60 to a proximal end 76 of the contacts 24, 26. The mounting arm 50 extends downward from the elevated position at which the contacts 24, 26 extend from the rear 74 of the dielectric frame 60 towards the circuit board 16. For example, the mounting arm 50 may extend at approximately a 45° angle from the elevated position towards the circuit board 16 or, alternatively, at a generally perpendicular angle. Although the mounting arms 50 of the signal and ground contacts 24, 26 extend downward towards the circuit board 16, optionally the mounting arms 50 extend along the contact axis 72 parallel to the mating axis 91. The mounting arms 50 each include a mounting interface 78 at the proximal end 76. The mounting interface 78 is the portion of the mounting arm 50 that is configured to engage the circuit board 18 on which the electrical connector 12 is mounted. In an embodiment, the circuit board 18 has a top side 80 that includes signal traces 82 and ground pads 84 thereon. Each of the ground pads 84 may be electrically commoned with a ground layer of the circuit board 16. The mounting interfaces 78 of the signal contacts 24 engage corresponding signal traces 82, and the mounting interfaces 78 of the ground contacts 26 engage corresponding ground pads 84. In an exemplary embodiment, the signal traces 82 and ground pads 84 are located only on the top side 80 of the circuit board 16, but are arranged in two rows, with a first row 86 configured to engage the mounting interfaces 78 of the upper row 62 of contacts 24, 26, and a second row 88 configured to engage the mounting interfaces 78 of the lower row 64 of contacts 24, 26.

In an exemplary embodiment, the base 42 of the ground bus 40 extends parallel to the lateral axis 93 of the electrical connector 12, such that the ground bus 40 extends across the row 62 of signal and ground contacts 24, 26. The base 42 may be separated from the row 62 of contacts 24, 26 by a gap 122 (shown in FIG. 4). The projections 46 extend from the base 42 across the gap 122 to engage the ground contacts 26 in the row 62, without engaging the signal contacts 24. Optionally, the projections 46 may engage every ground contact 26 in the row 62. The gap 122 between the base 42 and the signal contacts 24 may be filled by an insulator, such as the dielectric frame 60, the housing 20 (shown in FIG. 1), and/or air. The base 42 may be mounted on the dielectric frame 60 or the housing 20 to hold the ground bus 40 in place. Alternatively, or in addition, the projections 46 may be fixedly attached to the corresponding ground contacts 26, such as by soldering, to mount the ground bus 40. As described further with reference to FIG. 4, the electrical connector 12 may include two ground buses 40, such that projections 46 of one ground bus 40A engage the ground contacts 26 in the upper row 62, and the projections 46 of the other ground bus 40B engage the ground contacts 26 in the lower row 64.

In an embodiment, each set 44 of projections 46 is configured to engage a corresponding ground contact 26, such that multiple projections 46 engage each ground contact 26 at spaced-apart locations. For example, each set 44 may include two projections 46, with a front projection 46A and a rear projection 46B. The front projection 46A is disposed closer to the front 34 (shown in FIG. 1) of the housing 20 (FIG. 1) than the rear projection 46B. The front projection 46A is configured to engage the corresponding ground contact 26 at a location more proximate to the mating interface 52 of the mating arm 48 of the ground contact 26 than a location of engagement between the rear projection 46B and the ground contact 26. Optionally, the front and rear projections 46A, 46B are oriented in-line with each other and in-line with the contact axis 72 of the corresponding ground contact 26. As such, at least two projections 46 are configured to engage each ground contact 26 at spaced-apart locations that are both between the mating interface 52 and the mounting interface 78.

The ground contacts 26 of the electrical connector 12 are electrically commoned at the distal end 54 by engagement of the mating interfaces 52 to the ground pads 58 of the mating card module 14. The ground contacts 26 are electrically commoned at a proximal end 76 by engagement of the mounting interfaces 78 to the ground pads 84 of the circuit board 16. A ground path is defined between the mounting interface 78 and the mating interface 52. Such ground path has a certain length, defined as the distance along the ground contact 26 between the mounting interface 78 and the mating interface 52. Such ground path length corresponds with a certain resonance frequency. A longer ground path length corresponds with a relatively lower resonance frequency, while a shorter ground path length corresponds with a relatively higher resonance frequency.

In an exemplary embodiment, the ground contacts 26 are electrically commoned between the mating interfaces 52 and the mounting interfaces 78 by engagement of the ground contacts 26 to the projections 46 of the ground bus 40. The engagement of the projections 46 serves to shorten an effective ground path length of the ground contacts 26. The effective ground path length is the distance between grounding contact points. The grounding contact points are the locations along the ground contacts 26 that are engaged by grounding elements, such as the ground pads 58, 84 and the projections 46 of the ground bus 40. Shortening the effective ground path length of the ground contacts 26 may reduce the magnitude of resonance peaks in resonance waves that propagate through the ground contacts 26. In addition, shortening the effective ground path length may increase the resonance frequency to a level outside of a desired operating frequency band. For example, the resonance frequency may be increased to a level at which the resonance frequency does not have a detrimental effect on the signal performance of the pair of signal contacts 24. Such an increased level of resonance frequency may be at or above 12 GHz, 16 GHz, 20 GHz, or the like.

Figure 3:
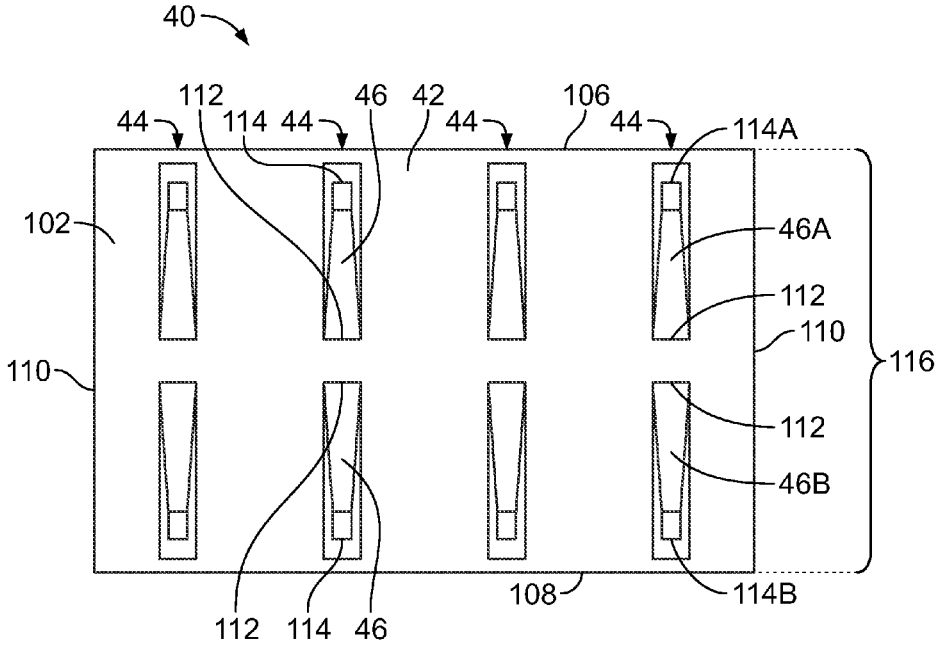
FIG. 3 is a top view of a ground bus for the electrical connector formed in accordance with an exemplary embodiment.

FIG. 3 is a top view of the ground bus 40 of the electrical connector 12 (shown in FIG. 2) formed in accordance with an exemplary embodiment. The base 42 of the ground bus 40 extends between a first side 102 and an opposite second side 104 (shown in FIG. 4). Optionally, the base 42 may be planar. The ground bus 40 may have a generally rectangular shape that is defined between a front edge 106, a rear edge 108 opposite the front edge 106, and two side edges 110. With reference to FIG. 2, the ground bus 40 may be oriented relative to the electrical connector 12 such that the front edge 106 is proximate to the mating arms 48 of the contacts 24, 26, and the rear edge 108 is proximate to the mounting arms 50. Optionally, the ground bus 40 may be symmetrical such that the front and rear edges 106, 108 are defined as "front" and "rear" based solely on orientation relative to the contacts 24, 26 of the electrical connector 12. The ground bus 40 may have a different shape in alternative embodiments.

In the illustrated embodiment, the ground bus 40 includes four sets 44 of projections 46 that extend from the second side 104 (shown in FIG. 4) of the base 42. Each set 44 is configured to engage a corresponding ground contact 26 (shown in FIG. 2). The number of sets 44 may correspond with the number of ground contacts 26 engaged by the ground bus 40. Optionally, more or less than four sets 44 may be provided in alternative embodiments, such as when the ground bus 40 is configured to engage more or less than four ground contacts 26. Each set 44 shown in FIG. 3 includes two projections 46 (for example, projections 46A and 46B), and both projections 46 are configured to engage the same ground contact 26 at spaced-apart locations. In alternative embodiments, one or more sets 44 may include three or more projections 46 that are configured to engage the same ground contact 26.

The ground bus 40 may be formed of an electrically conductive material such that a ground circuit is created through the ground bus 40 when the projections 46 engage the corresponding ground contacts 26 (shown in FIG. 2). In an exemplary embodiment, the ground bus 40 is stamped and formed, and the projections 46 are bent out of plane of the base 42 to extend from the second side 104 (shown in FIG. 4). For example, the projections 46 may be cantilevered deflectable fingers that are stamped from the base 42 to have a fixed end 112 that is attached to the base 42 and a free end 114 that is free from the base 42. The free end 114 is opposite the fixed end 112. The projections 46 in each set 44 may then be formed by bending the projections 46 out of the plane of the base 42, such as by bending the free end 114 downward (or upward). In alternative embodiments, the ground bus 40 may be formed using other processes, such as molding, casting, three-dimensional printing, or the like.

The fixed ends 112 are disposed proximate to each other, and may be approximately centrally positioned relative to the base 42. The free end 114A of one of the projections 46 (for example, projection 46A) is disposed proximate to the front edge 106, and the free end 114B of another projection 46 (for example, projection 46B) in the set 44 is proximate to the rear edge 108. As such, the free ends 114A, 114B of the projections 46A, 46B are spaced apart from each other a significant distance 116. Optionally, the distance 116 may be greater than half of a width of the base 42 between the front and rear edges 106, 108. The distance 116 may be approximately equal to the width of the base 42. The relative orientation of the projections 46 in each set 44 may be different in other embodiments. In alternative embodiments, instead of cantilevered deflectable fingers, the projections 46 may be tabs that are formed by bending the base 42 without making cuts or by adding extra material to the second side 104, such as by molding or adhesives, so the tabs project from the surface of the second side 104.

Figure 4:
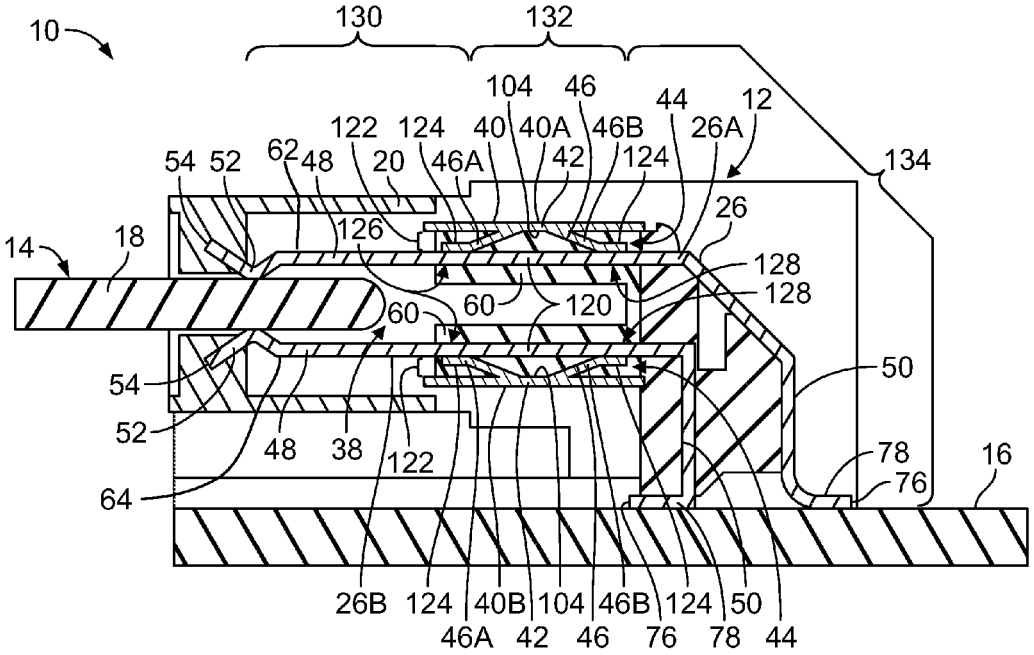
FIG. 4 is a cross-section of the portion of the electronic device according to an exemplary embodiment.

FIG. 4 is a cross-section of the portion of the electronic device 10 shown in FIG. 1 according to an exemplary embodiment. In FIG. 4, the mating connector 14 is mated to the electrical connector 12. The cross-section is taken through an upper ground contact 26A and a lower ground contact 26B of the electrical connector 12. The upper ground contact 26A is in the upper row 62 (shown in FIG. 2) of signal and ground contacts 24, 26 (FIG. 2), and the lower ground contact 26B is in the lower row 64 (FIG. 2). In an exemplary embodiment, the upper ground contact 26A and other ground contacts 26 in the upper row 62 are engaged by projections 46 of a first or upper ground bus 40A, and the lower ground contact 26B and other ground contacts 26 in the lower row 64 are engaged by projections 46 of a second or lower ground bus 40B. The upper and lower ground buses 40A, 40B may be identical or at least similar in shape and size. Optionally, the base 42 of the upper ground bus 40A is disposed above the upper ground contact 26A in the upper row 62, and the base 42 of the lower ground bus 40B is disposed below the lower ground contact 26B in the lower row 64. As such, the ground buses 40A, 40B do not extend within the slot 38, and do not risk interference with the mating edge of the card module circuit board 18. The two ground contacts 26A, 26B and two ground buses 40A, 40B shown in FIG. 4 are commonly referred to as ground contact 26 and ground buses 40, respectively.

In the illustrated embodiment, the mating interface 52 of the ground contacts 26 may be convex in shape to allow mating engagement with the card module circuit board 18 without scraping and/or catching on the surface of the circuit board 18. Optionally, the mating arms 48 of the ground contacts 26 may be angled towards a center of the slot 38 such that the mating arms 48 of the upper and lower ground contacts 26A, 26B extend at least partially towards each other. As the card module circuit board 18 is loaded within the slot 38, the mating arms 48 may be deflected outward by the engagement with the card module circuit board 18. The deflection biases the mating arms 48 against the card module circuit board 18, with each mating arm 48 imparting a normal force on the card module circuit board 18 to retain contact with the circuit board 18.

The mounting interface 78 of the ground contacts 26 may be surface mounted pins that are soldered or otherwise secured to the ground pads 84 (shown in FIG. 2) of the circuit board 16, as shown in the illustrated embodiment, to electrically connect the ground contacts 26 to the circuit board 16. For example, the mounting interface 78 includes pins that are bent transverse from the mounting arm 50 to extend parallel to the surface of the circuit board 16 to provide a base for soldering to the corresponding ground pads 84. In alternative embodiments, the circuit board 16 may include vias extending therethrough. The mounting interface 78 of the ground contacts 26 may be pins that are received within the vias and electrically connect to plating within the vias. For example, the pins may be compliant eye-of-the-needle pins that are secured in the vias by an interference fit, the pins may be soldered within the vias, or the like.

In the illustrated embodiment, the projections 46 of the ground buses 40 engage the corresponding ground contacts 26 at spaced-apart locations along an intermediate portion 120 of each ground contact 26. The intermediate portion 120 is between the mating arm 48 and the mounting arm 50. For example, the intermediate portion 120 may be the portion of the ground contact 26 held by the dielectric frame 60 and/or the housing 20. The base 42 of each of the ground buses 40 is separated from the corresponding ground contacts 26 by a gap 122. The projections 46 extend from the second side 104 of the base 42 across the gap 122 to engage the ground contacts 26. The projections 46 each include a contact interface 124 that is configured to mechanically engage the ground contact 26. Optionally, the contact interface 124 may be located at or near a distal end (for example, the free end 114 shown in FIG. 3) of the projection 46, and the contact interface 124 may be at least slightly convex in shape. The projections 46 may be deflectable such that the projections 46 deflect towards the respective base 42 when engaging the corresponding ground contact 26. The deflection may bias the projections 46 against the corresponding ground contact 26 to impart a normal force on the ground contact 26 and retain electrical connection therebetween. Alternatively, the contact interface 124 of the projections 46 may extend parallel to the ground contact 26 to allow for soldering or other secured connection to the ground contact 26 which retains the electrical connection therebetween.

In the illustrated embodiment, the ground buses 40 each include sets 44 of two projections 46, defined as a front projection 46A and a rear projection 46B. The front projection 46A engages the corresponding ground contact 26 at a front engagement location 126. The rear projection 46B engages the same ground contact 26 at a rear engagement location 128. The additional grounding contact points at the front and rear engagement locations 126, 128 shorten the effective ground path length of the ground contacts 26 to a first length 130 between the mating interface 52 (at or proximate to the distal end 54 of the contact 26) and the front engagement location 126, a second length 132 between the front and rear engagement locations 126, 128, and a third length 134 between the rear engagement location 128 and the mounting interface 78 (at or proximate to the proximal end 76 of the contact 26). The three lengths 130-134 need not be equal. The positioning of the projections 46A, 46B in each set 44 affects the engagement locations 126, 128, which directly affects the three lengths 130-134. As shown in FIG. 4, the third length 134 of the upper ground contact 26A is longer than the first and second lengths 130, 132. As such, the resonance frequency through the third length 134 of the ground contact 26A may be lower than the resonance frequencies through the first and second lengths 130, 132. Since the engagement locations 126, 128 between the projections 46A, 46B and the corresponding ground contacts 26 affect the resonance frequencies and other signal performance characteristics of the electrical connector 12, the engagement locations 126, 128 optionally may be predetermined to achieve desired resonance frequencies and/or frequency ranges, such as frequencies above 12 GHz, 16 GHz, 20 GHz, or the like. For example, the front and rear engagement locations 126, 128 may be selected such that the first, second, and third lengths 130-134 are generally equal in distance, which may provide a relatively high and constant resonance frequency throughout the length of the ground contact 26. In some embodiments, the front and rear engagement locations 126, 128 may be predetermined subject to physical space and/or part requirements in the housing 20 that may preclude equal spacing among the three lengths 130-134, even if desired. Alternatively, a desired resonance frequency may be below 12 GHz.

In an alternative embodiment, each set 44 may include at least three projections 46, such that the effective ground path length of the corresponding ground contact 26 is shortened to four or more lengths between grounding contact points. In another alternative embodiment, the sets 44 of the upper ground bus 40A may have a different number of projections 46 than the sets 44 of the lower ground bus 40B. For example, the upper ground contact 26A shown in FIG. 4 is longer than the lower ground contact 26B, and taking the different lengths into account, the sets 44 of the upper ground bus 40A may include at least one more projection 46 per set 44 than the sets 44 of the lower ground bus 40B.

Figure 5:
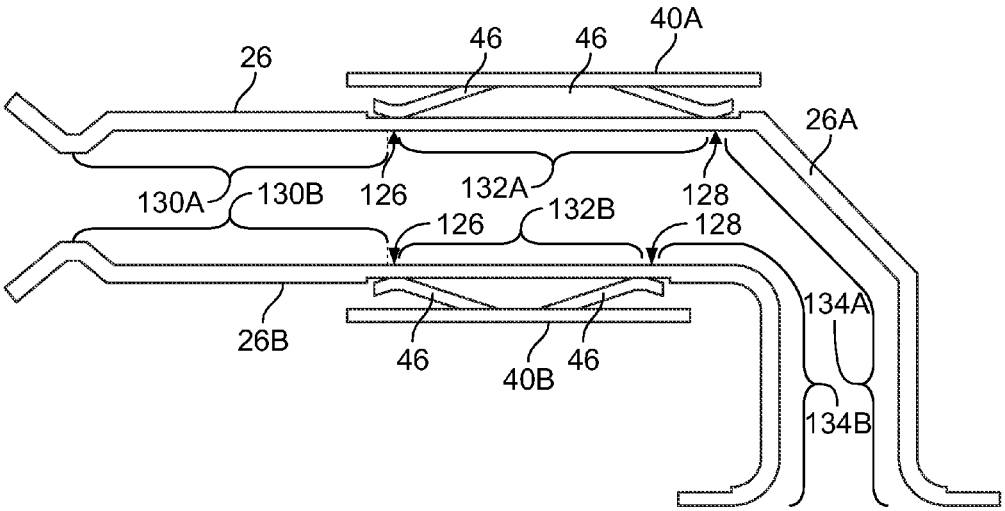
FIG. 5 is a side view of two ground buses and two ground contacts of the electrical connector according to an alternative embodiment.

FIG. 5 is a side view of the two ground buses 40A, 40B and the two ground contacts 26A, 26B of the electrical connector 12 (shown in FIG. 4) according to an alternative embodiment. As compared to the embodiment shown in FIG. 4, the only difference in FIG. 5 is that the upper ground bus 40A is wider than the upper ground bus 40A shown in FIG. 4. In FIG. 5, the upper ground bus 40A is wider than the lower ground bus 40B. The projections 46 of the upper ground bus 40A are spaced apart a greater distance than the projections 46 of the lower ground bus 40B. The second length 132A along the upper ground contact 26A between the front and rear engagement locations 126, 128 is greater than the second length 132B along the lower ground contact 26B between the engagement locations 126, 128. For example, as shown in FIG. 5, the first, second, and third lengths 130B, 132B, 134B along the lower ground contact 26B may be approximately equal or at least similar in distance. Since the upper ground contact 26A is longer than the lower ground contact 26B, the second length 132A is increased such that the first, second, and third lengths 130A, 132A, 134A along the upper ground contact 26A may also be approximately equal or at least similar in distance. As stated earlier, the number of projections 46 and the placement of the engagement locations between the projections 46 and the ground contacts 26 may be pre-determined to provide desired operating characteristics of the electrical connector 12, such as reduced magnitudes of resonance peaks, increased resonance frequencies, and the like, to improve signal performance. For example, equating the distances between grounding contact points may balance the electrical potential along the entire length of the ground contact 26, which reduces the magnitudes of resonance peaks.

Figure 6:
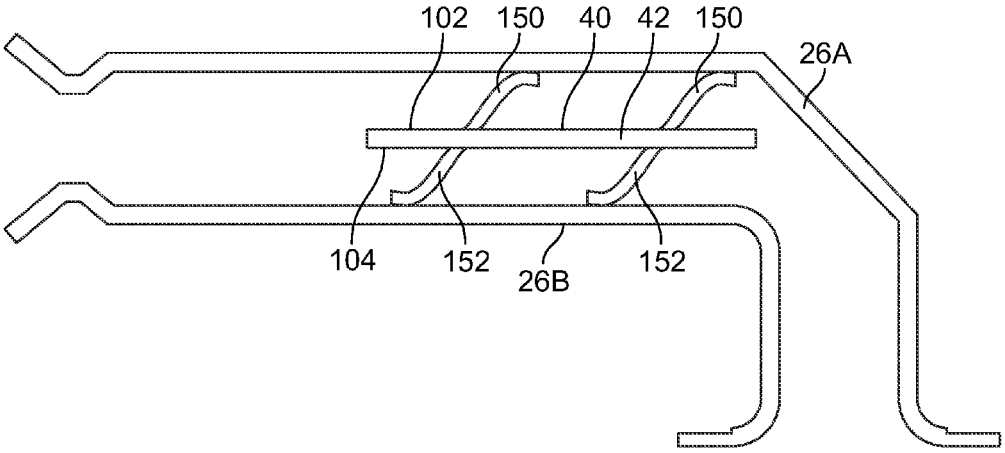
FIG. 6 is a side view of a single ground bus and two ground contacts of the electrical connector according to another alternative embodiment.

FIG. 6 is a side view of a single ground bus 40 and the two ground contacts 26A, 26B of the electrical connector 12 (shown in FIG. 4) according to another alternative embodiment. Instead of including two ground buses 40A, 40B that each electrically common the ground contacts 26 in only one row of signal and ground contacts 24, 26 as shown and described in FIGS. 2 and 4, the embodiment in FIG. 6 uses only a single ground bus 40 that is disposed between the upper and the lower ground contacts 26A, 26B. The ground bus 40 may extend between the upper and lower rows 62, 64 (shown in FIG. 2) of the signal and ground contacts 24, 26 (FIG. 2). The ground bus 40 includes upper projections 150 and lower projections 152. The upper projections 150 extend from the first or upper side 102 of the base 42 to engage corresponding upper ground contacts 26A in the upper row 62. The lower projections 152 extend from the second or lower side 104 of the base 42 to engage corresponding lower ground contacts 26B in the lower row 64. Optionally, the upper and lower projections 150, 152 may be similar in size and/or shape to the projections 46 shown in FIG. 4. For example, the projections 150, 152 may be cantilevered deflectable fingers that are cut and bent out of plane from the base 42. The base 42 may need to be wide enough to support the increased number of projections 150, 152 that may be in-line with each other.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a front and a rear, the housing including a slot defined through the front configured to receive a mating connector therein;

signal contacts held in the housing, the signal contacts being arranged within the slot to mate with the mating connector;

ground contacts held in the housing and interspersed among the signal contacts, the ground contacts being arranged within the slot to mate with the mating connector; and a ground bus that includes a base and multiple sets of projections extending from the base, each set including at least two projections that engage a same corresponding ground contact at spaced-apart locations, the sets of projections connected via the base to create a ground circuit between the ground contacts engaged by the ground bus;

wherein the signal contacts and the ground contacts are arranged in an upper row above the slot and a lower row below the slot, the ground bus is a first ground bus that engages the ground contacts in the upper row, and the electrical connector further comprises a second ground bus that engages the ground contacts in the lower row, wherein the ground contacts in the upper row are longer than the ground contacts in the lower row, each set of projections of the first ground bus engaging the corresponding ground contact in the upper row at engagement locations spaced apart by a first distance, each set of projections of the second ground bus engaging the corresponding ground contact in the lower row at engagement locations spaced apart by a second distance different than the first distance.

2. The electrical connector of claim 1, wherein the signal contacts and the ground contacts are arranged in the upper row along a lateral axis, the base of the first ground bus extending parallel to the lateral axis and separated from the upper row of signal and ground contacts by a gap, the projections of the first ground bus extending across the gap to engage each of the ground contacts in the upper row without engaging the signal contacts in the upper row.

3. The electrical connector of claim 1, wherein each set of projections includes a front projection and a rear projection that is in-line with the front projection along a contact axis, the front projection being disposed closer to the front of the housing than the rear projection and configured to engage the corresponding ground contact at the engagement location more proximate to a mating interface of the ground contact than the engagement location between the rear projection and the ground contact, the mating interface configured to engage the mating connector.

4. The electrical connector of claim 1, wherein the base of the first ground bus is planar and the projections are cantilevered deflectable fingers being stamped and bent out of the plane of the base to extend from a common side of the base.

5. The electrical connector of claim 1, wherein the base of the first ground bus has a front edge and a rear edge, the projections being cantilevered deflectable fingers each having a fixed end that is directly attached to the base and an opposite free end that is not directly attached to the base, the fixed ends of two projections in each set being attached to a spine segment of the base, the free end of one of the projections in each set being proximate to the front edge, the free end of another projection in each set being proximate to the rear edge.

6. The electrical connector of claim 1, wherein each ground contact includes a mating interface and a mounting interface, the mating interface being configured to engage the mating connector, the mounting interface being configured to engage a circuit board, the projections of each set engaging the corresponding ground contact at the engagement locations along the ground contact between the mating and mounting interfaces to shorten an effective ground path length of the ground contacts.

7. The electrical connector of claim 6, wherein each set of projections includes a front projection that engages the corresponding ground contact at a front engagement location and a rear projection that engages the corresponding ground contact at a rear engagement location, wherein the effective ground path length of the corresponding ground contact is shortened to a first length between the mating interface and the front engagement location, a second length between the front and rear engagement locations, and a third length between the rear engagement location and the mounting interface.

8. The electrical connector of claim 6, wherein each set of projections engages the corresponding ground contact at predetermined locations between the mating interface and the mounting interface to increase a resonance frequency of the electrical connector to above 12 GHz.

9. The electrical connector of claim 1, wherein the housing defines a right angle housing configured to be mounted to a circuit board such that the slot receives the mating connector in a direction parallel to the circuit board.

10. The electrical connector of claim 1, wherein the first distance is greater than the second distance.

11. The electrical connector of claim 1, wherein the base of the first ground bus is disposed above the upper row, and the second ground bus includes a base that is disposed below the lower row.

12. The electrical connector of claim 1, wherein each set of projections includes two projections separated by a spine segment of the corresponding base, the spine segment is centrally positioned between a front edge of the base and a rear edge of the base.

13. An electrical connector comprising:

a housing having a top and a bottom, the bottom being configured to be mounted to a circuit board, the housing having a front and a rear opposite the front, the housing defining a slot through the front configured to receive a mating card module therein and configured to hold the mating card module parallel to the circuit board;

signal contacts and ground contacts held in the housing, the signal contacts and the ground contacts being arranged in an upper row above the slot and a lower row below the slot, each of the signal contacts and the ground contacts having a mating arm that extends into the slot and is configured to engage the mating card module, each of the signal contacts and the ground contacts having a mounting arm that extends at an angle from the mating arm and is configured to be terminated to the circuit board;

a first ground bus that includes a base and multiple sets of projections extending from the base, each set including two projections that are in-line with each other along a respective contact axis and engage a same corresponding ground contact in the upper row at engagement locations spaced-apart by a first distance, the sets of projections of the first ground bus being electrically connected by the base of the first ground bus; and a second ground bus that includes a base and multiple sets of projections extending from the base, each set including two projections that are in-line with each other along a respective contact axis and engage a same corresponding ground contact in the lower row at engagement locations spaced-apart by a second distance different than the first distance, the sets of projections of the second ground bus being electrically connected by the base of the second ground bus.

14. The electrical connector of claim 13, wherein the projections in each set engage the corresponding ground contact at the engagement locations along an intermediate portion of the ground contact that is between the mating arm and the mounting arm.

15. The electrical connector of claim 13, wherein the ground contacts are configured to be electrically commoned at a distal end by engagement of the mating arms to corresponding ground pads of the mating card module, the ground contacts configured to be electrically commoned at a proximal end by engagement of the mounting arms to corresponding ground pads of the circuit board, the ground contacts being electrically commoned between the distal and proximal ends by engagement of the ground contacts to the corresponding projections to shorten an effective ground path length of each of the ground contacts.

16. The electrical connector of claim 15, wherein each set of projections includes a front projection that engages the corresponding ground contact at a front engagement location and a rear projection that engages the corresponding ground contact at a rear engagement location, wherein the effective ground path length of the corresponding ground contact is shortened to a first length between the distal end and the front engagement location, a second length between the front and rear engagement locations, and a third length between the rear engagement location and the proximal end.

17. The electrical connector of claim 13, wherein the signal contacts and the ground contacts are arranged in the upper row along a lateral axis, the base of the first ground bus extending parallel to the lateral axis and separated from the upper row of signal and ground contacts by a gap, the projections of the first around bus extending across the gap to engage each of the ground contacts in the upper row without engaging the signal contacts in the upper row.

18. The electrical connector of claim 13, wherein each set of projections includes a front projection and a rear projection that is in-line with the front projection along the respective contact axis, the front projection being disposed closer to the front of the housing than the rear projection and configured to engage the corresponding ground contact at the engagement location more proximate to the mating arm of the ground contact than the engagement location between the rear projection and the ground contact.

19. The electrical connector of claim 13, wherein the projections are stamped and bent from the corresponding base to define multiple corresponding windows in the corresponding base.

20. The electrical connector of claim 13, wherein the projections are cantilevered deflectable fingers each having a fixed end that is directly attached to the corresponding base and an opposite free end that is not directly attached to the corresponding base, the fixed ends of the two projections of each set being disposed between the free ends of the two projections along the respective contact axis.

* * * * *